United States Patent [19]

Iitsuka

[11] 4,450,323

[45] May 22, 1984

[54] REVERSIBLE SWITCH

[75] Inventor: Takeshi Iitsuka, Katsuta, Japan

[73] Assignee: Hitachi Koki Company, Limited, Tokyo, Japan

[21] Appl. No.: 324,578

[22] Filed: Nov. 24, 1981

[51] Int. Cl.[3] ..... H01H 9/00; H01H 19/38

[52] U.S. Cl. ..... 200/1 V; 200/6 R; 200/11 K

[58] Field of Search ..... 200/1 V, 155 R, 303, 200/6 R, 11 G, 11 J, 11 K, 17 R, 6 BB

[56] References Cited

U.S. PATENT DOCUMENTS

| | | | |
|---|---|---|---|
| 2,329,442 | 9/1943 | Popp | 200/303 |
| 2,921,147 | 1/1960 | Hutt | 200/6 BB |
| 3,637,967 | 1/1972 | Braun | 200/1 V X |
| 4,045,637 | 8/1977 | Mongeau | 200/303 |
| 4,239,947 | 12/1980 | Breitung et al. | 200/303 X |

FOREIGN PATENT DOCUMENTS

| | | |
|---|---|---|
| 974323 | 11/1964 | United Kingdom . |
| 1444777 | 8/1976 | United Kingdom . |
| 1570845 | 7/1980 | United Kingdom . |

*Primary Examiner*—J. R. Scott

*Attorney, Agent, or Firm*—Lowe, King, Price & Becker

[57] ABSTRACT

A reversible switch comprises four fixed contact members mounted within a base, each having an arcuate contact jointly defining an interrupted circular wall. A cylindrical body rotatable within the wall includes a pair of contact members slidably engageable with the fixed contacts to reverse polarity of an electrical circuit when rotated 90° between first and second positions. An eccentric pin projecting from the body through an arcuate slot formed in a cover mounted on the base rotates the body via engagement with a lever pivotably mounted on the cover. The rotatable body is selectively retained in first or second position by a spring-biased cap received in a pair of positioning holes in the cover.

16 Claims, 5 Drawing Figures

REVERSIBLE SWITCH

BACKGROUND OF THE INVENTION

The present invention relates to a reversible switch for selectively changing polarities in an electrical circuit.

A variety of reversible switches have been proposed and used, which however are unsatisfactory in that they are complex in structure, composed of a large number of parts, and costly to manufacture.

SUMMARY OF THE INVENTION

It is an object of the present invention to provide a reversible switch which is comprised of a reduced number of parts, simple in construction, and can be manufactured inexpensively.

Another object of the present invention is to provide a reversible switch having fixed and movable contacts slidable against one another without being fused together.

According to the present invention, four fixed contact members having respective arcuate contacts are mounted on a base and have terminals for external connection, the arcuate contacts jointly defining an interrupted circular wall in which there is fitted a rotatable body supporting a pair of movable contact members each having ends slidable into contact with the arcuate contacts of adjacent two of the four fixed contact members. The rotatable body is angularly movable about its own axis for an angular interval between a first position in which each movable contact member electrically connects an adjacent pair of fixed contact members and a second position in which each movable contact member electrically connects another adjacent pair of fixed contact members. The rotatable body has an axial shaft rotatably fitted in a hole in a cover mounted on the base, and a pin located in eccentric relation to the axial shaft and extending through an arcuate slot defined in the cover. A lever is pivotally mounted on the cover and held in guiding engagement with the pin projecting through the arcuate slot to angularly move the rotatable body between the first and second positions. Since the movable and fixed members are slidable against each other, they are prevented from being fused together while the switch is in use.

BRIEF DESCRIPTION OF THE DRAWINGS

The present invention will now be described with reference to the drawings, in which.

DETAILED DESCRIPTION

Figure 1:
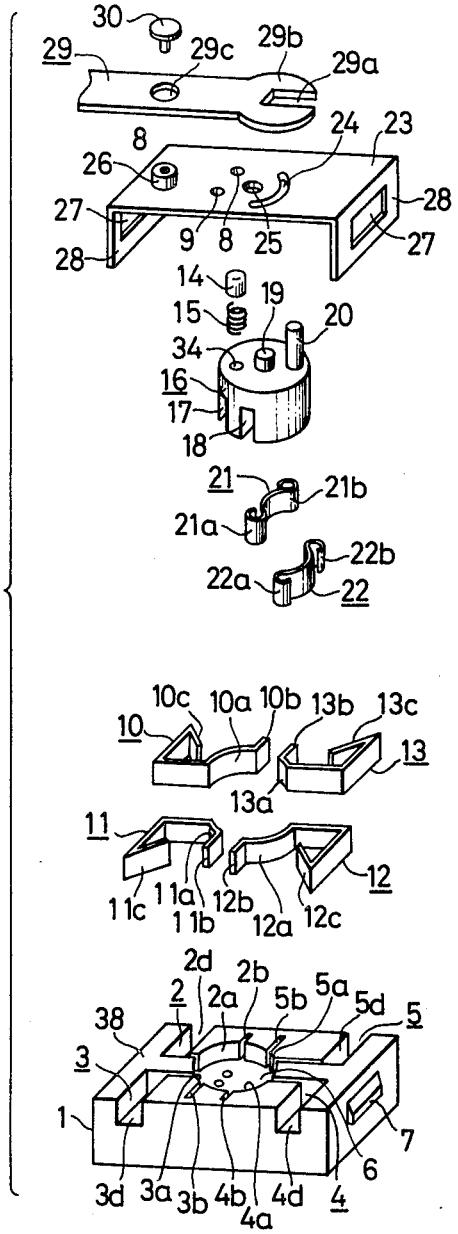
FIG. 1 is an exploded perspective view of a reversible switch according to the present invention.
Figure 3:
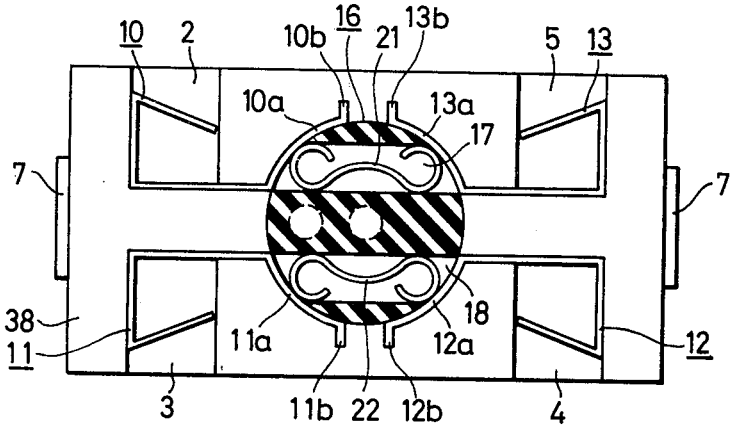
FIG. 3 is an enlarged plan view, partly in cross section, of a base on which fixed contact members and a rotatable body with movable contact members are mounted.

As shown in FIG. 1, a reversible switch according to the present invention comprises four fixed contact members 10, 11, 12, 13 mounted on a base 1 and having four arcuate contacts **10*a*, 11*a*, 12*a*, 13*a*, respectively. Each arcuate contact 10*a*–13*a* extends approximately 90 degrees to jointly define an interrupted ciruclar wall as best shown in FIG. 3. Fixed contact members 10–13 also include retainer end portions 10*b*, 11*b*, 12*b*, 13*b*, respectively, and V-shaped terminal ends 10*c*, 11*c*, 12*c*, 13*c***, respectively, for external connection.

Base 1 has a central circular recess 6 and four channels 2, 3, 4, 5 communicating with the central recess. Recess 6 is defined partly by four arcuate walls **2*a*, 3*a*, 4*a*, 5*a*, against which arcuate contacts 10*a*, 11*a*, 12*a*, 13*a*, are held, respectively. Base 1 further includes four slits 2*b*, 3*b*, 4*b*, 5*b* receiving retainer end portions 10*b*, 11*b*, 12*b*, 13*b* respectively therein to position fixed contact members 10–13 on the base. Channels 2–5 include slots 2*d*, 3*d*, 4*d*, 5*d* in which terminal ends 10*c*–13*c* are housed, respectively. Recess 6 and channels 2–5 are open at an upper surface of base 1 so that fixed contact members 10–13** can easily be placed in the aforesaid position on the base.

A cylindrical rotatable body 16 has a pair of parallel grooves 17, 18 defined in one end thereof which extend in a direction normal to the body axis. A central axial shaft 19 projects from the other end of body 16. A pin 20 is mounted on said other end of rotatable body 16 in eccentric relation to central axial shaft 19. A pair of movable contact members 21, 22 are received respectively in grooves 17, 18, as shown in FIG. 3. Movable contact members 21, 22 comprise elongate spring-type elements having curved ends **21*a*, 21*b*, and 22*a*, 22*b*, respectively. Cylindrical rotatable body 16 with movable contact members 21, 22 retained therein is fitted within circular recess 6 and surrounded by the circular wall defined by arcuate contacts 10*a*, 11*a*, 12*a*, 13*a*. Curved ends 21*a*, 21*b*, 22*a*, 22*b* are held against arcuate contacts 10*a*, 11*a*, 12*a*, 13*a* respectively through open ends of grooves 17, 18** (FIG. 3).

A cover 23 has an arcuate guide slot 24 extending through an angular interval of 90 degrees to receive pin 20 extending therethrough. A bearing hole 25 in cover 23 receives central shaft 19 of rotatable body 16. Since arcuate guide slot 24 extends around bearing hole 25, as shown in FIG. 1, cylindrical rotatable body 16 is angularly movable about its own axis through 90 degrees, and is confined in its angular motion by arcuate guide slot 24. Cover 23 has a pair of opposite sidewalls 28 each having an opening 27. Base 1 has on its opposite ends a pair of ledges 7 (FIG. 3) which snap respectively in openings 27 of sidewalls 28 when cover 23 is mounted on the base.

Figure 4:
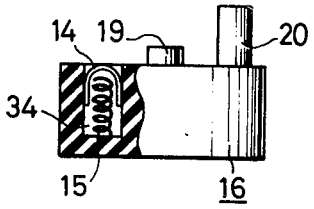
FIG. 4 is an enlarged front elevational view, partly in cross section, of the rotatable body illustrated in FIG. 1

Cylindrical rotatable body 16 further includes a cavity 34 within the end thereof supporting shaft 19 and pin 20. Cavity 34 houses therein a compression spring 15, as shown in FIG. 4. A cap 14 is mounted on spring 15 and normally urged thereby to project out of cavity 34. Cover 23 includes a pair of positioning holes 8, 9 angularly spaced from each other with respect to bearing hole 25 in diametrically opposing relation to ends of arcuate slot 24 across hole 25. With cover 23 and rotatable body 16 assembled together, the cap 14 is selectively receivable in holes 8, 9 when pin 20 on rotatable body 16 is located at a diametrically opposite end of arcuate slot 24. Grooves 17, 18 pin 20, and the holes 8,

9 are relatively positioned such that when the rotatable body 16 is in a position angularly spaced 45 degrees from the position illustrated in FIG. 3, pin 20 is located centrally within arcuate slot 24.

An actuator lever 29 has a notch 29*a* defined in a widened end 29*b* thereof to loosely receive pin 20 projecting through arcuate slot 24, and an opening 29*c* fitted over a stud 26 mounted on cover 23. Widened end 29*b* is sized to cover arcuate slot 24 wherever pin 20 is positioned. Stud 26, bearing hole 25, and the center of (i.e., colinear) arcuate slot 24 are aligned with each other on an imaginary straight line with positioning holes 8, 9 being located symmetrically one on each side of the line. Actuator lever 29 is retained on cover 23 by a fastener 30 affixed to stud 26 fitted in opening 29*c*.

Figure 2:
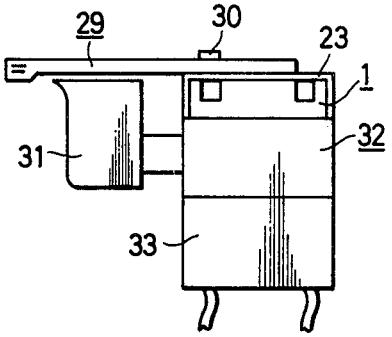
FIG. 2 is a side elevational view of the reversible switch shown in FIG. 1, as attached to a trigger-actuated switch body.

The reversible switch of the present invention is mounted on a trigger-actuated switch body 32 having a trigger 31 and a trigger-actuated switch 33, as shown in FIG. 2.

Figure 5:
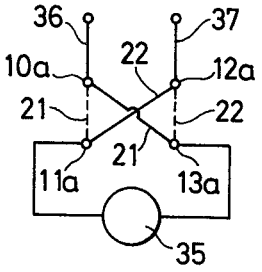
FIG. 5 is a wiring diagram of an electrical circuit including the reversible switch of the present invention, the diagram being illustrative of alternative connections selectively provided by the reversible switch.

FIG. 5 shows an electrical circuit including a motor 35 supplied with electric power from power supply lines 36, 37 through the reversible switch of the invention.

Operation of the reversible switch thus constructed is as follows. In the position of parts shown in FIG. 5, fixed contacts 10*a*, 13*a* electrically connected to each other by movable contact member 21 while fixed contacts 11*a*, 12*a* electrically connected to each other by movable contact member 22. At this time, the pin 20 is held aginst one of the ends of arcuate slot 24. When the rotatable body 26 is angularly moved through 45 degrees from the position of FIG. 3, the pin 20 is brought into the central position in the arcuate slot 24, whereupon movable contact members 21, 22 are out of contact with arcuate contacts 10*a*, 11*a*, 12*a*, 13*a*, breaking the electrical circuit. Further angular movement of rotatable body 16 through additional 45 degrees causes the movable contact members 21, 22 to electrically connect arcuate connects 10*a*, 11*a* and 12*a*, 13*a*, respectively. Motor 35 is now connected to the power supply in opposite polarity. When pin 20 is positioned at either one of the ends of the arcuate slot 24, the cap 14 is resiliently retained in either one of positioning holes 8, 9, thus maintaining rotatable body 16 stable in a selected position to prevent accidental rotation.

Although a certain preferred embodiment of the present invention has been shown and described in detail, it should be understood that many changes and modifications may be made therein without departing from the scope of the appended claims.

What is claimed is:

1. A reversible switch comprising:

(a) a base;

(b) four fixed contact members mounted on said base and having arcuate contacts, respectively, spaced angularly from each other and jointly defining an interrupted circular wall;

(c) a substantially cylindrical rotatable body fitted in said circular wall for angular movement about its own axis, said cylindrical body having a pair of grooves;

(d) a pair of movable contact members resiliently accommodated in said grooves respectively, and each having contact ends slidable into contact respectively with adjacent two of said fixed contact members, said rotatable body being angularly movable through an angular interval between a first position in which each movable contact member electrically connects a pair of said adjacent fixed contact members and a second position in which each movable contact member electrically connects another pair of said adjacent fixed contact members;

(e) a cover mounted on said base and supporting said rotatable body for angular movement thereof; and (f) means on said rotatable body and said cover for angularly moving said rotatable body through said angular interval between said first and second positions, said grooves extending generaly rectilinearly parallel to each other respectively on each side of said axis at one axial end through said cylindrical rotatable body, each of said four fixed contact members being non-elastically fitted in said base, said arcuate contacts having concave contact surfaces of substantially equal dimensions.

2. A reversible switch according to claim 1, said base having a circular recess in which said arcuate contacts and said rotatable body are disposed.

3. A reversible switch according to claim 2, said circular recess being partly defined by four angularly spaced arcuate walls against which said arcuate contacts are held, respectively.

4. A reversible switch according to claim 2, said base having four slots communicating with said circular recess, said fixed contact members having terminals, respectively, disposed respectively in said slots for external connection.

5. A reversible switch according to claim 1, each of said grooves having open ends in which said contact ends of one of said movable contact members are received for slidable contact with said adjacent two of the arcuate contacts.

6. A reversible switch according to claim 5, said cover having a bearing hole, said rotatable body having an axial shaft mounted on the other end of said cylinder and journalled in said bearing hole.

7. A reversible switch according to claim 1, each of said movable contact members comprising an elongate arcuately formed springy body having curved ends serving as said contact ends.

8. A reversible switch according to claim 1, said base having a pair of ledges on opposite ends thereof, said cover including a pair of sidewalls having a pair of openings, respectively, in which said ledges are snap fitted.

9. A reversible switch according to claim 1, said rotatable body having on the other end an axial shaft rotatably supported on said cover, said rotating means comprising a pin mounted on said other end of said cylinder and in eccentric relation to said axial shaft, and an arcuate guide slot defined in said cover through which said pin extends.

10. A reversible switch according to claim 9, said arcuate guide slot extending through an angular interval of 90 degrees.

11. A reversible switch according to claim 9, said rotatable body having in said other end a cavity located in diametrically opposing relation to said pin, a compression spring disposed in said cavity and a cap mounted on said compression spring and normally urged thereby to project from said cavity, said cover having a pair of holes in which said cap is selectively retainable for stably positioning said rotatable body in one of said first and second positions to prevent accidental rotation thereof.

12. A reversible switch according to claim 11, said pair of holes being angularly spaced 90 degrees from each other with respect to a bearing hole located between said pair of holes and the arcuate slot and located in diametrically opposite relation to ends of said arcuate guide slot.

13. A reversible switch according to claim 9, said means further including an actuator lever angularly movably mounted on said cover and held in guiding engagement with said pin projecting through said arcuate guide slot.

14. A reversible switch according to claim 13, said actuator lever having a notch receiving said pin.

15. A reversible switch according to claim 1, wherein said fixed contacts are formed substantially identical to each other and said movable contacts are formed substantially identical to each other.

16. A reversible switch according to claim 1, wherein each of said pair of grooves is substantially straight and extends generally orthogonal to the axis of the cylindrical body.

* * * * *